US005917142A

United States Patent [19]

Chang

[11] Patent Number: 5,917,142

[45] Date of Patent: Jun. 29, 1999

[54] FUSEE CAP HAVING A SPARK DEFLECTOR SHIELD

[76] Inventor: Calvin B. Chang, P.O. Box 8, Davis, Calif. 95617

[21] Appl. No.: 08/999,455

[22] Filed: Dec. 29, 1997

[51] Int. Cl.[6] ..... F42B 4/26; F42B 4/04

[52] U.S. Cl. ..... 102/336; 102/343; 102/344; 102/361; 102/275.6

[58] Field of Search ..... 102/336, 343, 102/344, 361, 275.6

[56] References Cited

U.S. PATENT DOCUMENTS

| | | | |
|---|---|---|---|
| 3,648,615 | 3/1972 | Wilkaitis | 102/336 |
| 3,678,856 | 7/1972 | Barocca et al. | 102/343 |
| 3,741,121 | 6/1973 | Miller | 102/336 |
| 3,788,222 | 1/1974 | Evans | 102/343 |
| 3,901,152 | 8/1975 | Alexander | 102/343 |
| 4,046,075 | 9/1977 | Spangler | 102/336 |
| 4,380,957 | 4/1983 | Makainai, Jr. | 102/336 |
| 5,113,765 | 5/1992 | Carey et al. | 102/336 |
| 5,149,912 | 9/1992 | Waidner et al. | 102/343 |
| 5,313,888 | 5/1994 | Martin | 102/336 |

*Primary Examiner*—Peter A. Nelson
*Attorney, Agent, or Firm*—Thomas R. Lampe

[57] ABSTRACT

A fusee cap includes a fusee cap body having a scratch surface for frictional engagement with the head of a fusee to cause fusee ignition and a spark deflector shield projecting from the fusee cap body to deflect sparks produced during ignition.

9 Claims, 2 Drawing Sheets

FUSEE CAP HAVING A SPARK DEFLECTOR SHIELD

TECHNICAL FIELD

This invention relates to a fusee cap construction and more particularly to a fusee cap utilized to engage the head of a fusee to cause ignition of the fusee.

BACKGROUND OF THE INVENTION

Fusees are devices commonly employed to alert motorists and others to the existence of potentially hazardous road conditions. Such devices, also known as road flares or highway flares, additionally are employed by railroad workers and others for a variety of purposes. Fusees are commonly available products, being sold for example by auto part stores and industrial supply companies.

One well known type of fusee utilizes a fusee cap incorporating a scratch surface. One wishing to ignite a fusee manually removes the fusee cap from the fusee to expose an ignition compound at the fusee head. The scratch surface of the fusee cap is then manually brought into frictional engagement with the ignition compound and moved relative to the fusee to ignite the ignition compound.

Sparks are often emitted during ignition of a fusee utilizing the scratch cap method of ignition just described. These sparks can cause bodily injury to the individual igniting the fusee as well as damage clothing he or she is wearing.

DISCLOSURE OF INVENTION

The present invention relates to a fusee cap that will reduce the risk of burn injuries during ignition of fusees.

The fusee cap includes a fusee cap body defining an interior for accommodating the head of a fusee and including a closed end having a scratch element with a scratch surface for frictional engagement by the head of a fusee to cause fusee ignition.

A spark deflector shield is connected to the fusee cap body, partially surrounds the scratch element, and projects from the fusee cap body to deflect sparks produced during frictional engagement between the scratch surface and the head of a fusee when igniting the fusee.

Other features, advantages, and objects of the present invention will become apparent with reference to the following description and accompanying drawings.

BEST MODE FOR CARRYING OUT THE INVENTION

Figure 1:
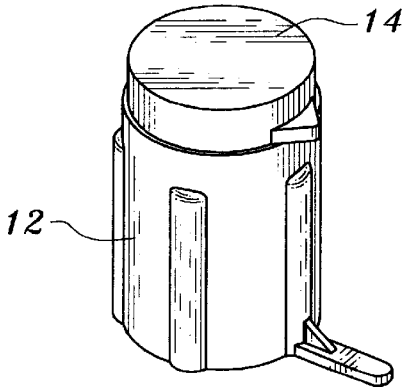
Fig. 1 (Prior Art)
FIG. 1 is a perspective view of a prior art fusee cap.
Figure 2:
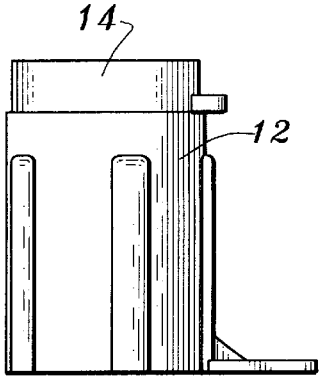
Fig. 2 (Prior Art)
FIG. 2 is a side elevation view of the prior art fusee cap.

FIGS. 1 and 2 disclose a typical prior art fusee cap including a fusee cap body 12 which defines an interior for accommodating the head of a fusee. Connected to fusee cap body 12 is a closure 14 which can be removed manually from the fusee cap body to expose a scratch surface at the outer end of the fusee cap body. In use, the fusee and the scratch surface of the fusee cap are brought together after removing the cap from the fusee. The fusee and fusee cap are then relatively moved with the ignition compound of the fusee in engagement with the scratch surface of the fusee cap to ignite the fusee. As mentioned above, this is likely to result in formation of sparks that could harm the user.

FIGS. 3–7 illustrate a fusee cap constructed in accordance with the teachings of the present invention.

The fusee cap includes a fusee cap body 20 similar to the fusee cap body employed in the prior art construction shown in FIGS. 1 and 2. Fusee cap body 20 defines an interior for accommodating the head of a fusee 22 (FIGS. 6 and 7) and covers the ignition compound located at one end of the fusee.

Also in common with the prior art fusee cap construction, the fusee cap body 20 includes a closed end 24 having a scratch element 26 with a scratch surface 28 for frictional engagement by the head of a fusee to cause fusee ignition.

A closure 30 is normally in position over the scratch element and in frictional engagement therewith to maintain the scratch surface 28 covered until use.

The fusee cap of the present invention also includes a spark deflector shield 40 connected to the fusee cap body. In the arrangement illustrated, both the fusee cap body and the spark deflector shield are formed of plastic and are integrally molded together. However, the spark deflector shield may be connected to the fusee cap body by any suitable expedient.

Figure 3:
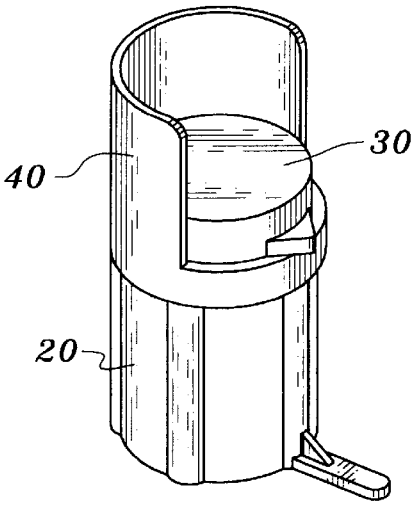
FIG. 3 is a perspective view of a fusee cap constructed in accordance with the teachings of the present invention.
Figure 4:
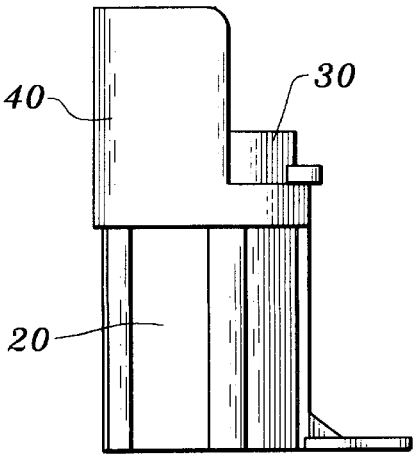
FIG. 4 is a side view of the fusee cap of FIG. 3.
Figure 5:
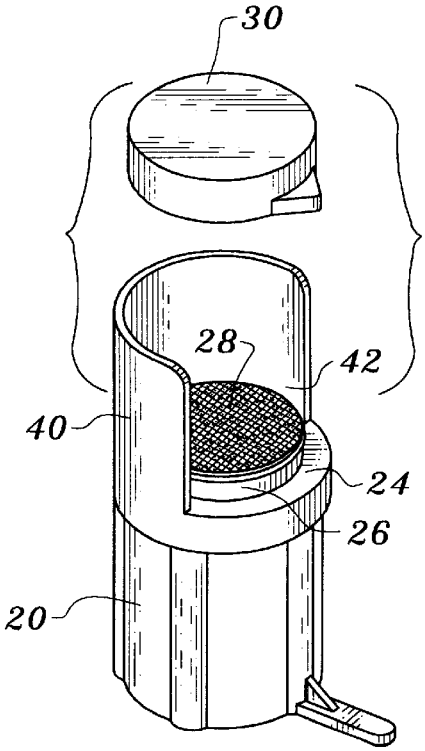
FIG. 5 is an exploded, perspective view illustrating the fusee cap of the present invention with a closure removed from the fusee cap body to expose a scratch surface on the cap body.

The illustrated spark deflector shield 40 comprises a curved plate projecting from the fusee cap body. The scratch element 26 and the curved plate are spaced from one another and define a curved channel 42 for receiving the bottom end of closure 30. When the closure 30 is received in the curved channel it is in frictional engagement with the scratch element 26 to retain the closure on the fusee cap body until the closure is manually removed therefrom. FIGS. 3 and 4 show the closure 30 in frictional with the scratch element and covering the scratch surface.

The scratch element 26 has a circular-shaped outer peripheral surface and the inner curved deflector shield surface of the spark deflector shield is substantially uniformly spaced from the scratch element circular-shaped outer peripheral surface. Such spacing is sufficient to provide clearance for the side wall of the closure 30. In the arrangement illustrated, the spark deflector shield extends more than half way around the scratch element.

Figure 6:
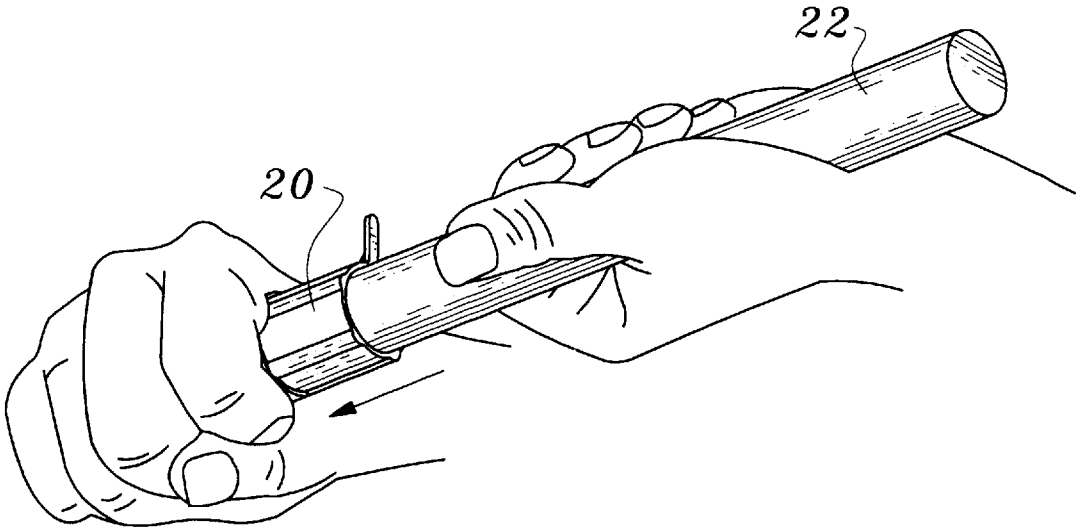
FIG. 6 is a perspective view illustrating the fusee cap of the present invention being manually removed from a fusee.
Figure 7:
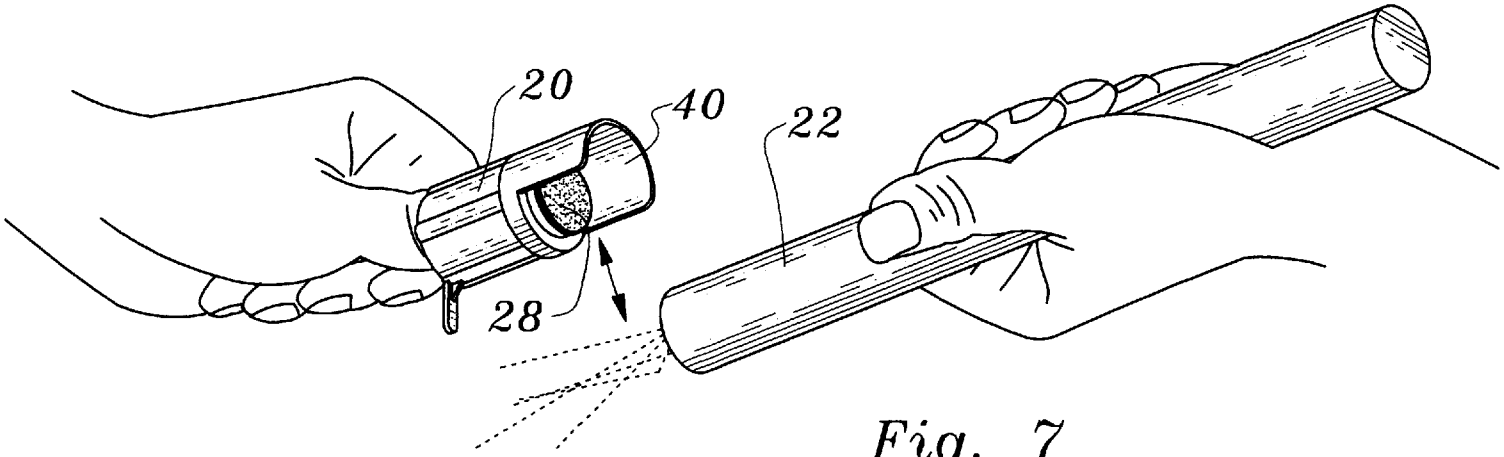
FIG. 7 is a perspective view illustrating use of the removed fusee cap to ignite the fusee.

FIG. 6 shows the fusee cap being removed from an associated fusee 22. This will expose a conventional ignition compound (not shown) at the end of the fusee formerly covered by the fusee cap. Next, the end of the fusee having the ignition compound is brought into engagement with the scratch surface 28, it being understood that closure 30 previously has been removed. The fusee cap and the fusee are slid relative to one another to ignite the ignition compound and the fusee. In use, the person igniting the fusee will maintain the spark deflector shield between himself or herself and the fusee end being ignited. This will cause any sparks resulting from ignition to be deflected away from the individual.

I claim:

1. A fusee cap for use with a fusee having a fusee head with an ignition compound coating an outer surface of said fusee head to ignite the fusee, said fusee cap comprising, in combination:

a fusee cap body defining an interior for accommodating the fusee head of a fusee and for covering an ignition compound coating an outer surface of the fusee head and including a closed end partially defining said interior having a scratch element with a generally planar scratch surface disposed on the outside of said closed end and spaced from said interior for frictional engagement with the fusee head of the fusee after removal of the fusee head from said interior to cause fusee ignition due to relative sideways movement between said generally planar scratch surface and said fusee head; and a spark deflector shield having an open distal end connected to said fusee cap body, partially surrounding said scratch element, and projecting from said fusee cap body in a direction away from said generally planar scratch surface to deflect sparks produced during frictional engagement between the generally planar scratch surface and the fusee head of the fusee due to relative sideways movement between said scratch element and said fusee head, said spark deflector shield defining an opening in a side thereof communicating with the open distal end allowing passage of the fusee therethrough during relative sideways movement between said scratch element and said fusee head during ignition of said fusee.

2. The fusee cap according to claim 1 wherein said spark deflector shield is integrally connected to said fusee cap body.

3. The fusee cap according to claim 2 wherein said spark deflector shield and said fusee cap body are of molded plastic construction.

4. The fusee cap according to claim 1 wherein said spark deflector shield comprises a curved plate.

5. The fusee cap according to claim 4 additionally comprising a closure removably connectable to said fusee cap body, said scratch element and said curved plate being spaced from one another and defining a curved channel for receiving said closure, said closure when received in said curved channel being in frictional engagement with said scratch element to retain said closure on said fusee cap body.

6. The fusee cap according to claim 1 wherein said spark deflector shield extends around at least one half of said scratch element.

7. The fusee cap according to claim 1 wherein said spark deflector shield has a curved deflector shield surface spaced from said scratch element.

8. The fusee cap according to claim 7 wherein said scratch element has a circular-shaped outer peripheral surface and wherein said curved deflector shield surface is substantially uniformly spaced from said scratch element circular-shaped outer peripheral surface.

9. The fusee cap according to claim 1 wherein said spark deflector shield includes two spaced ends defining said opening, said spaced ends extending outwardly from said generally planar scratch surface to the open distal end of said spark deflector shield.

* * * * *